United States Patent [19]

Crossley

[11] 4,420,460

[45] Dec. 13, 1983

[54] GRAIN REFINEMENT OF TITANIUM ALLOYS

[75] Inventor: Frank A. Crossley, Palo Alto, Calif.

[73] Assignee: Lockheed Missiles & Space Company, Inc., Sunnyvale, Calif.

[21] Appl. No.: 446,331

[22] Filed: Dec. 2, 1982

[51] Int. Cl.[3] ..... C22C 14/00

[52] U.S. Cl. ..... 420/417; 420/418

[58] Field of Search ..... 420/417, 418, 419, 420, 420/421; 148/133, 421, 407; 164/55.1

[56] References Cited

U.S. PATENT DOCUMENTS

| | | | |
|---|---|---|---|
| 2,818,336 | 12/1957 | Swazy et al. | 420/417 |
| 3,433,626 | 3/1969 | Bomberger, Jr. | 420/417 |
| 3,625,679 | 12/1971 | Bomberger, Jr. | 420/417 |

FOREIGN PATENT DOCUMENTS

| | | | |
|---|---|---|---|
| 616321 | 7/1978 | U.S.S.R. | 420/418 |

OTHER PUBLICATIONS

Okazaki et al., "Grain Growth Kinetics in Ti-N Alloys", *Titanium Science and Technology, vol. 3, pp. 1649-1660, 1973.*

*Primary Examiner*—Peter K. Skiff

*Attorney, Agent, or Firm*—Richard H. Bryer

[57] ABSTRACT

As-cast titanium alloys characterized by fine grain structures are readily produced by inoculation of the alloys prior to or during the casting thereof with small amounts of at least one composition selected from the group consisting of titanium—0.4 to 15 weight percent carbon, titanium—1.4 to 6 weight percent nitrogen and titanium—1.3 to 10 weight percent oxygen.

7 Claims, No Drawings

GRAIN REFINEMENT OF TITANIUM ALLOYS

TECHNICAL FIELD

This invention relates to the grain refinement of as-cast titanium alloys whereby titanium alloys of fine grain structure are readily and conveniently produced.

BACKGROUND ART

There is increasing interest in using high strength titanium alloys as cast components in order to reduce costs compared to components machined from wrought forms. However, the large grain size frequently associated with as-cast titanium is detrimental to ductility, toughness and fatigue resistance compared with wrought products. Furthermore, grain size increases with increasing weight and section thickness of the cast component, resulting in increasing detriment to mechanical properties.

The problem of large grain size imposes severe restrictions on the potential of titanium alloy castings to compete structurally with components machined from wrought forms.

Grain refinement of aluminum castings by the addition of an inoculant has long been practiced by aluminum foundries. The most commonly used inoculant for aluminum-base alloys is $Al_3Ti$. Grain refinement of aluminum by titanium is due to the occurrence of a peritectic reaction at the aluminum-rich end of the aluminum-titanium phase diagram; see "Mechanism of Grain Refinement of Aluminum Alloys", Crossley and Mondolfo, Transactions AIME, Vol. 191, pp. 1143–1148 (1951). Briefly, the peritectic principle of grain refinement states that during cooling of the melt crystals of the primary phase form, which react peritectically with the liquid upon further cooling, the peritectic reaction transforms at least partially the primary crystals into crystals of the secondary phase, which then act as nuclei for solidification of the remaining melt. The least amount of titanium necessary for occurrence of the peritectic reaction in binary combination with aluminum under equilibrium conditions is 0.15 weight percent; see Hansen, "Constitution of Binary Alloys", 2d Ed., McGraw-Hill Book Co., p. 146 (1958). The principle of peritectic grain refinement has also been successfully applied to copper alloys; see, "Grain Refinement of Copper", Gould, Form and Wallace, Modern Castings, May 1980 and Transactions American Foundrymen's Society, Vol. 68, 1960. An alloying addition of iron to copper in sufficient amount to produce the peritectic reaction; i.e., 2.8 weight percent or more, produces grain refinement; see, Hansen, supra, p. 581.

Smaller amounts of iron added in powder form just before casting of the copper also produces grain refinement. In this case, the local concentrations exceed the requirement for the peritectic reaction, although the overall composition under homogeneous conditions does not. Therefore, localized nucleation occurs producing grain refinement.

A difficulty in applying the peretectic principle for grain refinement more generally is the rarity of alloying additions which form a peritectic reaction with the base metal at a sufficiently low solute concentration. At the present state of the art, no inoculants for the grain refinement of as-cast titanium alloys exist.

Carbon, nitrogen and oxygen are known to cause peritectic reactions with titanium. However, the minimum quantities of these additions needed to produce the peritectic reaction are associated with unacceptable embrittlement of titanium alloys. The amounts in weight percent are: 0.25 percent carbon, about 1.3 percent nitrogen and about 1.2 percent oxygen; see Hansen, supra, pp. 384, 990 and 1069. These amounts may be compared with the maximum amounts in weight percent found in commercial titanium alloys of 0.1 percent carbon, 0.07 percent nitrogen and 0.25 percent oxygen; see Metals Handbook, Vol. 3, 9th Ed., American Society for Metals, Metals Park, Ohio, p. 357 (1980). These limits, therefore, prohibit a direct application of the peritectic principal of grain refinement to titanium alloys.

Furthermore, several patents which are directed to as-cast titanium alloys containing up to 2 weight percent carbon do not mention or indicate any grain refining effect associated with carbon; see U.S. Pat. Nos. 2,818,338; 2,818,337; 2,818,336; 2,818,335; 2,818,334; 2,818,333 and 2,786,756.

Several patents do comment on the fact that carbon additions up to 0.25 weight percent and up to 0.3 weight percent contribute to fine grain size in wrought and recrystallinized titanium; see, U.S. Pat. Nos. 2,669,513 and 2,596,486. Consistent with the prior art, applicant has verified that 0.3 weight percent carbon additions to the titanium alloys Ti-6Al-4V (the most commonly utilized alloy) and Ti-2.7Al-13V-7Sn-2Zr (U.S. Pat. No. 3,986,868) had no beneficial effects on the as-cast grain size.

DISCLOSURE OF INVENTION

Briefly, in accordance with the invention, it has been discovered that as-cast titanium alloys characterized by fine grain structures are readily produced by the inoculation of titanium alloys prior to or during casting thereof with small amounts of at least one inoculant composition selected from the group consisting of titanium—0.4 to 15 weight percent carbon, titanium—1.4 to 6 weight percent nitrogen and titanium—1.3 to 10 weight percent oxygen.

A preferred compositional range for the inoculants of the invention is titanium—5 weight percent carbon, titanium—5 weight percent nitrogen and titanium—10 weight percent oxygen.

BEST MODE OF CARRYING OUT THE INVENTION

A practical compositional range for the inoculants of the invention is titanium—0.4 to 15 weight percent carbon, titanium—1.4 to 6 weight percent nitrogen and titanium—1.3 to 10 weight percent oxygen. The lower limits are based on the minimum compositions necessary to produce peritectic reactions, with the upper limits being based on producibility considerations.

As-cast titanium alloys characterized by fine grain structure and improved properties are produced by inoculation of the titanium alloys prior to or during casting thereof with at least one inoculant composition of the invention. The inoculation is made to molten titanium prior to its solidification. The inoculant acts as seeds for crystal growth as the molten titanium cools from a liquid to a solid. As the time of exposure of the inoculant to the molten alloy increases, dissolution of the inoculant also increases, until the inoculant is completely dissolved. At this point, no peritectic reaction and no nucleation occurs.

The exceptional activity of the titanium atom in the molten state ensures that the molten titanium alloy, particularly an alloy containing at least 70 weight percent titanium, surrounding the inoculant particles will undergo paritectic reaction with the inoculant particles. This reaction converts the particles to seeds to nucleate the volume of molten alloy immediately surrounding the particles.

Desirably, the average inoculant particle size is about one micrometer. Particles significantly larger than this tend to act as defects in the alloy with a potential degradation in fatigue properties. The particular particle size to be utilized, however, is readily ascertainable by routine experimentation.

Preferably, the inoculant compositions are added to titanium alloys in amounts of about 0.5 to about 1 milligram of inoculant per pound of alloy when the average particle size is about one micrometer. Smaller or larger amounts may be utilized, however, as determined by routine experimentation.

To facilitate processing the small quantities of inoculants utilized to effect grain refinement of titanium alloys, it is convenient to dilute them with an inert carrier material which plays no role in the grain refinement process and is dissolved by the molten titanium. The inert carrier serves two purposes: (i) provide bulk to facilitate handling, and (ii) facilitate dispersion of the inoculant particles since there would be less chance of agglomeration.

To be effective, the carrier material should have a melting point higher than than to which the mold is preheated for casting. This varies from foundry to foundry and with the complexity of the casting. The carrier material should also have a melting point below that of the molten titanium alloy so the carrier will quickly melt and disperse the inoculant particles.

Examples of materials that may be utilized as carrier materials are manganese and aluminum powders. An amount of carrier material 200 times the amount of inoculant to be utilized is effective for the desired purposes although greater or lesser amounts may be utilized as foundry experience dictates. The amounts of carrier material contemplated for use in the invention will have neglible if any influence on the properties of the titanium alloy. For example, 200 milligrams of manganese or aluminum added to a pound of titanium alloy equals 0.04 weight percent of the alloy which is less than the major impurities in titanium alloy.

The beneficial effects on grain size of the inoculation of titanium alloys by the compositions of the invention are demonstrated in the following Table 1.

Small ingots of commercial alloy Ti-6Al-4V and alloy Ti-2.5Al-13V-7Sn-2Zr, representative of the alloys disclosed in U.S Pat. No. 3,986,868 were melted in a water cooled copper hearth, nonconsumable electrode arc furnace. The ingots were inoculated by two means: (i) melting over a small amount of inoculant in powder form placed on the hearth, and (ii) drilling a hole to the center of a parallelepiped of alloy and filling the hole with inoculant, the hole being horizontal when the alloy charge was placed on the hearth for melting.

It should be noted that by employing the water cooled copper hearth, nonconsumable electrode furnace as the means for demonstrating the advantages of the invention, the inoculants were put to a very severe test. Under such conditions, the cooling rate is exceptionally high and solidification occurs under a very high thermal gradient. Such conditions promote grain growth over heterogenous nucleation, and consequently large grain size. Furthermore, the molten titanium has the shortest possible time to interact with the inoculant and thereby achieve heterogenous nucleation.

The ingots were examined under the indicated magnification. Composition A is Ti-6Al-4V. Composition B is Ti-2.5Al-13V-7Sn-2Zr.

TABLE 1

| Ingot No. | Composition | Inoculant | Process | Grain Size (mm) | Magnification (x) |
|---|---|---|---|---|---|
| 1 | B | None | — | 0.81 | 5 |
| 2 | B | Ti—5C | 2 | 0.46 | 5 |
| 3 | B | Ti—5N | 2 | 0.46 | 5 |
| 4 | B | Ti—10(O) | 2 | 0.47 | 5 |
| 5 | A | None | — | 1.07 | 100 |
| 6 | A | Ti—5C | 1 | 0.32 | 100 |
| 7 | B | None | — | 0.81 | 100 |
| 8 | B | Ti—5C | 1 | 0.21 | 100 |
| 9 | B | Ti—5N | 1 | 0.24 | 100 |
| 10 | B | Ti—10(O) | 1 | 0.23 | 100 |

Referring to ingots 1, 5 and 7, it is seen that the as-cast titanium alloys of the prior art have a coarse grain structure. It is well understood by metallurgists that such coarseness of grains is indicative of poor mechanical properties.

In contradistinction to the coarseness of the grain structures of the prior art alloys, the inoculated alloys of the invention, ingots 2 through 4, 6 and 8 through 10, show a significant improvement and refinement of the grains at the site of inoculation. It is well known in the art that finer grain size benefits metal alloys, including titanium alloys in several ways: higher strength, improved ductility improved toughness and higher fatigue resistance. Grain sizes in the reference alloys 1,5 and 7 were measured in the same locale as the inoculated alloys to which they are compared by process.

Grain refinement throughout a large casting is merely a matter of adding the inoculant by any one of several means that disperse the inoculant throughout the casting.

One means of adding the inoculant to molten titanium takes advantage of the fact that the casting process most commonly used by the titanium casting industry is the lost wax, investment mold casting process. Here, the inoculant diluted with carrier would be sintered into rods to facilitate handing. Rods of appropriate length would be inserted into the wax pattern of the cast shape with a small amount protruding beyond the surface of the wax pattern. This protrusion would lock the rod inoculant into the shell mold subsequently formed on the wax pattern. The molten titanium alloy, when poured into the mold cavity, would quickly melt the lower melting manganese or aluminum carrier and thus disperse the inoculant.

Other means include pouring the molten titanium alloy into a mold which is lined with inoculant powder, adding inoculant powder to the consumable titanium alloy electrode, and adding inoculant powder to molten titanium alloys just before casting.

I claim:

1. A method for the grain refinement of cast titanium alloys containing at least 70 weight percent titanium comprising inoculating said molten alloys prior to or during casting thereof with at least one material which is not completely dissolved in said alloys and which is selected from the group of materials consisting of titanium and 0.4 to 15 weight percent carbon, titanium and 1.4 to 6 weight percent nitrogen and titanium and 1.3 to 10 weight percent oxygen, said material being added to titanium alloys in amounts of about 0.5 to about 1 milligram of inoculant per pound of alloy when the average inoculant particle size is about one micrometer.

2. A method in accordance with claim 1 wherein said material is titanium and 0.4 to 15 weight percent carbon.

3. A method in accordance with claim 2 wherein said material is titanium and 5 weight percent carbon.

4. A method in accordance with claim 1 wherein said material is titanium and 1.4 to 6 weight percent nitrogen.

5. A method in accordance with claim 4 wherein said material is titanium and 5 weight percent nitrogen.

6. A method in accordance with claim 1 wherein said material is titanium and 1.3 to 10 weight percent oxygen.

7. A method in accordance with claim 6 wherein said material is titanium and 10 weight percent oxygen.

* * * * *